US009236682B2

(12) United States Patent
Glick et al.

(10) Patent No.: US 9,236,682 B2
(45) Date of Patent: Jan. 12, 2016

(54) CYLINDRICAL ELECTRIC CONNECTOR WITH BIASED CONTACT

(71) Applicant: Lear Corporation, Southfield, MI (US)

(72) Inventors: Michael Glick, Farmington Hills, MI (US); Reshma Rathod, Auburn Hills, MI (US); Tulasi Sadras-Ravindra, Canton, MI (US); Slobodan Pavlovic, Novi, MI (US)

(73) Assignee: Lear Corporation, Southfield, MI (US)

( * ) Notice: Subject to any disclaimer, the term of this patent is extended or adjusted under 35 U.S.C. 154(b) by 53 days.

(21) Appl. No.: 14/177,976

(22) Filed: Feb. 11, 2014

(65) Prior Publication Data

US 2014/0235114 A1 Aug. 21, 2014

Related U.S. Application Data

(60) Provisional application No. 61/765,273, filed on Feb. 15, 2013.

(51) Int. Cl.
*H01R 13/187* (2006.01)
*H01R 13/62* (2006.01)
*H01R 13/193* (2006.01)

(52) U.S. Cl.
CPC ..... *H01R 13/62* (2013.01); *H01R 13/187* (2013.01); *H01R 13/193* (2013.01); *H01R 2201/26* (2013.01)

(58) Field of Classification Search
CPC .... H01R 13/187; H01R 13/111; H01R 43/16; H01R 13/113
USPC ..... 439/843, 849, 846
See application file for complete search history.

(56) References Cited

U.S. PATENT DOCUMENTS

| | | | | | |
|---|---|---|---|---|---|
| 3,861,776 | A * | 1/1975 | Deal | H01R 13/187 | 439/380 |
| 4,685,761 | A * | 8/1987 | Locati | 439/843 | |
| 5,033,982 | A | 7/1991 | Lucas | | |
| 5,078,622 | A | 1/1992 | Hunt, III et al. | | |
| 5,147,229 | A * | 9/1992 | Nestor | H01R 13/187 | 439/843 |
| 5,326,288 | A | 7/1994 | Lu et al. | | |
| 5,471,479 | A * | 11/1995 | McRoberts et al. | 714/711 | |
| 5,591,039 | A | 1/1997 | Matthews | | |
| 5,601,457 | A | 2/1997 | Le Gall | | |
| 5,653,615 | A * | 8/1997 | Inaba | H01R 13/17 | 439/827 |
| 5,730,628 | A * | 3/1998 | Hawkins | A61N 1/3752 | 439/843 |
| 5,921,822 | A | 7/1999 | Kennedy et al. | | |
| 6,042,432 | A * | 3/2000 | Hashizawa et al. | 439/843 | |
| 6,048,225 | A | 4/2000 | Dechanteloup et al. | | |
| 6,102,751 | A | 8/2000 | Becker | | |
| 6,254,439 | B1 | 7/2001 | Endo et al. | | |

(Continued)

FOREIGN PATENT DOCUMENTS

| | | | |
|---|---|---|---|
| DE | 102009044179 | A1 | 12/2010 |
| WO | 2010028263 | A1 | 3/2010 |
| WO | 2010060370 | A1 | 6/2010 |

*Primary Examiner* — Phuong Dinh
(74) *Attorney, Agent, or Firm* — MacMillan, Sobanski & Todd, LLC

(57) ABSTRACT

An electric connector includes a terminal body defining an interior space. An electric contact is located within the internal space. The electric contact includes a base contact ring that is biased into engagement with the terminal body and an outer ring that is biased into engagement with the terminal body. A contact arm extends from the base contact ring to the outer ring.

17 Claims, 4 Drawing Sheets

(56) References Cited

U.S. PATENT DOCUMENTS

| | | | | |
|---|---|---|---|---|
| 6,264,508 | B1 | 7/2001 | Lehmann | |
| 6,358,104 | B2 | 3/2002 | Daugherty et al. | |
| 6,520,998 | B1 * | 2/2003 | Scholler | H01R 13/187 439/843 |
| 6,811,453 | B2 | 11/2004 | Williams | |
| 7,101,192 | B1 | 9/2006 | Bordeau et al. | |
| 7,393,252 | B2 | 7/2008 | Ribeau et al. | |
| 7,416,453 | B2 | 8/2008 | Germani | |
| 7,537,472 | B1 | 5/2009 | Schwarz et al. | |
| 7,578,708 | B2 | 8/2009 | Hachadorian | |
| 7,841,912 | B2 | 11/2010 | Hachadorian | |
| 7,963,793 | B2 | 6/2011 | Poulin et al. | |
| 7,972,167 | B2 | 7/2011 | Amit et al. | |
| 8,142,238 | B2 * | 3/2012 | Heigl | H01R 13/111 439/843 |
| 8,731,671 | B2 * | 5/2014 | Rodby et al. | 607/37 |
| 2002/0122690 | A1 | 9/2002 | Poon et al. | |
| 2003/0040228 | A1 | 2/2003 | Finzer et al. | |
| 2008/0254670 | A1 | 10/2008 | Balsells et al. | |
| 2009/0061700 | A1 * | 3/2009 | Coe et al. | 439/843 |
| 2010/0311266 | A1 | 12/2010 | Dilmaghanian et al. | |
| 2011/0034053 | A1 | 2/2011 | Matsumoto et al. | |
| 2011/0171850 | A1 | 7/2011 | Brown, II | |
| 2011/0201223 | A1 | 8/2011 | Kurumizawa et al. | |

* cited by examiner

CYLINDRICAL ELECTRIC CONNECTOR WITH BIASED CONTACT

CROSS-REFERENCE TO RELATED APPLICATIONS

This application claims the benefit of U.S. Provisional Application No. 61/765,273, filed Feb. 15, 2013, the disclosure of which is incorporated herein by reference.

BACKGROUND OF THE INVENTION

The present invention relates in general to electric terminals and, more specifically, to a barrel-type cylindrical electric terminal.

Electric connectors may be used in automobiles, for example, in connecting an electric vehicle to an external power source in order to charge batteries on the vehicle. One type of electric connector includes a cylindrical female connector and a male pin connector that is inserted into the female connector. The female connector includes an electric contact that is biased into contact with the male pin. The electric contact is typically a sheet metal spring that includes multiple flexible, inwardly-bent arms. The male pin engages the arms and pushes them outwardly, establishing electric communication between the female connector and the male connector. The electric contact may be the portion of the female connector with the highest resistance to electric current. It would be advantageous to have an improved electric contact for a cylindrical, female electric connector.

SUMMARY OF THE INVENTION

This invention relates to an electric connector. The electric connector may include a terminal body. The terminal body may define an interior space. An electric contact may be located within the internal space. The electric contact may include a base contact ring. The base contact ring may be biased into engagement with the terminal body. The electric contact may include an outer contact ring. The outer contact ring may be biased into engagement with the terminal body. The electric contact may include a contact arm. The contact arm may extend from the base contact ring to the outer ring. The contact arm may be angled in an inward direction from the base contact ring to a contact area. The contact arm may be angled in an outward direction from the contact area to the outer ring. The interior space may be generally cylindrical. The base contact ring may be generally cylindrical. The outer ring may be generally cylindrical. The electric connector may include an end cap. The end cap may retain the electric contact in the interior space. The interior space may extend between an interior wall of the terminal body and an outer opening. The end cap may extend through the outer opening. The end cap may include interior walls. A channel may be defined between the end cap interior walls and the terminal body. The electric contact may include an outer contact end. The outer contact end may be the portion of the electric contact closest to the outer opening. The outer contact end may be located within the channel. The end cap may include an inner cap end that is located farther from the outer opening than the outer contact end is. The contact area may be located a first distance from the outer opening. The contact area may be located a second distance from the interior wall. The first distance may be different from the second distance. The electric contact may include a plurality of contact arms. From the contact base ring, the plurality of contact arms may angle in an inward direction toward a terminal axis to respective contact areas. From the contact areas, the contact arms may angle in an outward direction away from the terminal axis to the outer ring.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
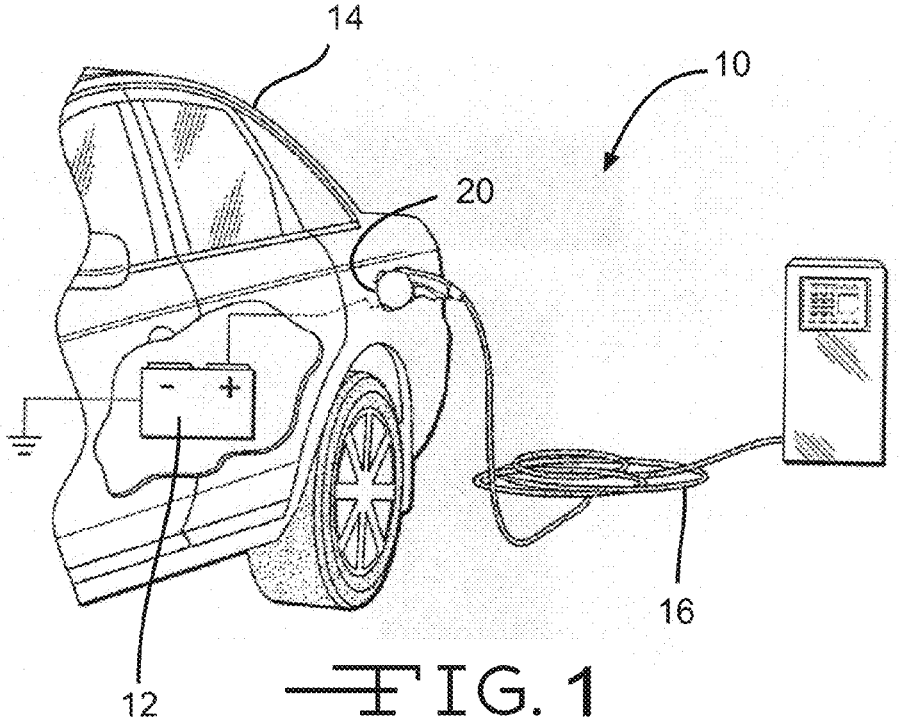
FIG. 1 is a perspective view of a vehicle charging system.

Referring now to the drawings, there is illustrated in FIG. 1 a charging system, indicated generally at 10. The charging system 10 is operable to charge a battery 12 on a vehicle 14 using an external source of power. The charging system 10 includes a cord 16 and an attached connector assembly 18. The connector assembly 18 is configured to mate with an inlet 20 on the vehicle to allow the charging system 10 to connect the external source of power to the battery 12.

Figure 2:
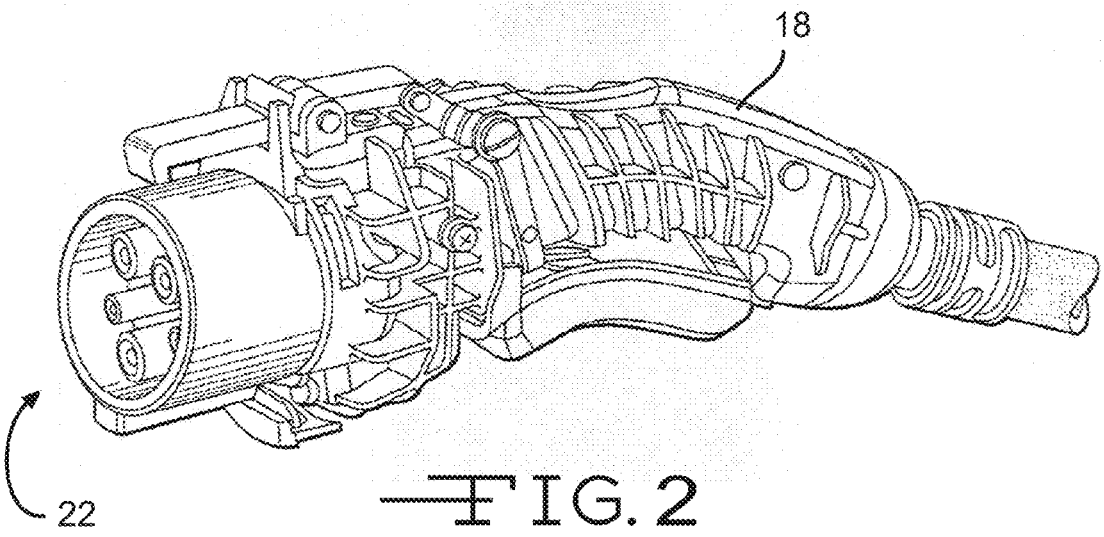
FIG. 2 is a perspective view of a connector assembly of the vehicle charging system from FIG. 1.

Referring now to FIG. 2, a perspective view of the connector assembly 18 is shown. The connector assembly 18 includes a plurality of connector terminals, indicated generally at 22. The connector terminals 22 are positioned and arranged to engage a plurality of corresponding pin terminals (not shown) included in the charging inlet 20. The number of connector terminals 22 shown is for illustrative purposes only and may be other than that shown, if desired. When the connector assembly 18 is mated with the inlet 20, the connector terminals 22 mate with the corresponding pin terminals and may provide circuits for electric current, data transfer, or any other desired purpose.

Figure 3:
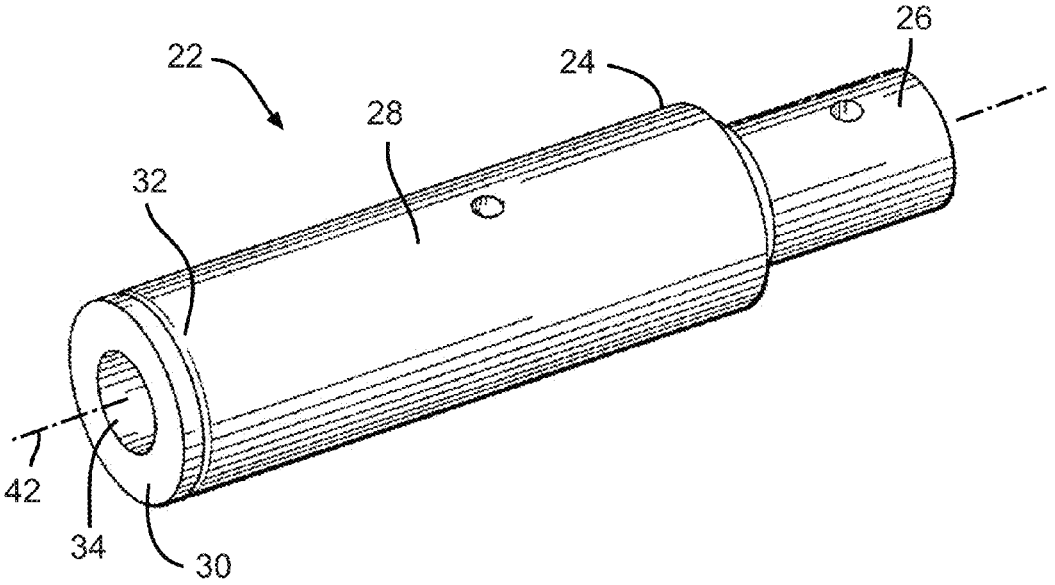
FIG. 3 is a perspective view, from above, of a connector terminal from the connector assembly from FIG. 2.

Referring now to FIG. 3, a perspective view of one connector terminal 22 is shown. The connector terminal 22 includes a terminal body 24 that includes a connection portion 26 and a terminal portion 28. The connection portion 26 is configured to connect to the connector assembly 18 while the terminal portion 28 is configured to mate with one of the pin terminals on the inlet 20. The illustrated terminal body 24 is made of a single piece of electrically-conductive material. However, the terminal body 24 may be made of any desired material and may have any desired shape or configuration. The connector terminal 22 also includes an end cap 30 attached to an outer end 32 of the terminal portion 28. The illustrated end cap 30 is made of an electrically-insulating material. However, the end cap 30 may be made of any desired material. The end cap 30 defines a cap opening 34, the purpose of which will be described below.

Figure 4:
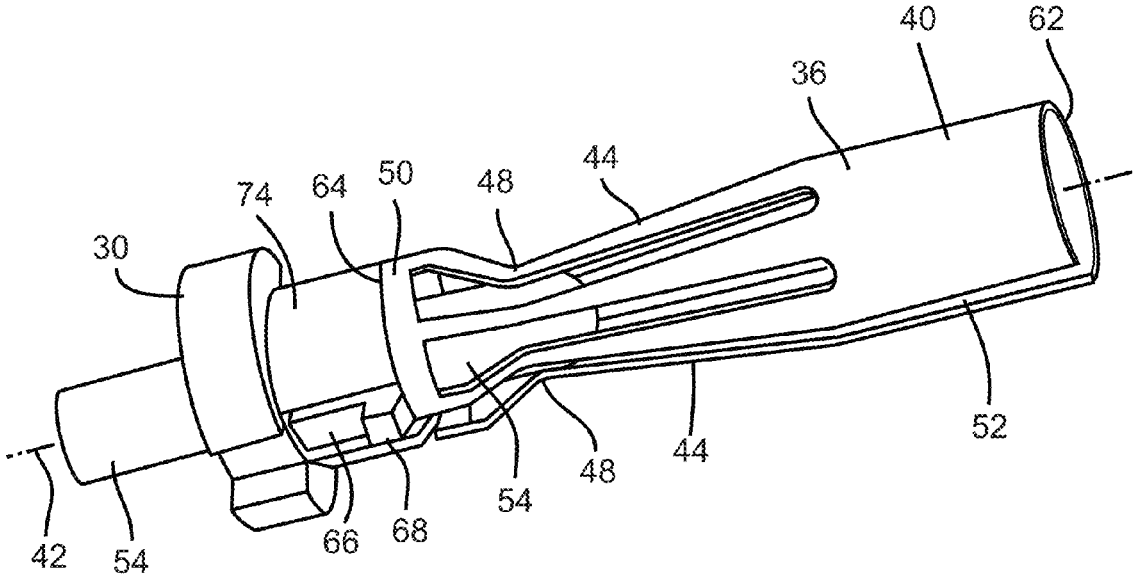
FIG. 4 is a perspective view, from below, of a spring portion and end cap of the connector terminal from FIG. 3, as well as a mated male terminal.

Referring to FIG. 4, a perspective view, taken from below, of the connector terminal 22 is shown with the terminal body 24 removed for clarity. The connector terminal 22 includes an electric contact 36 that is located within the terminal body 24, as will be described below. The illustrated electric contact 36 is stamped from a single piece of resilient sheet metal and bent into the illustrated shape. However, the electrical contact 36 may be made of any desired material and may be made using any desired technique. The electric contact 36 includes a generally cylindrical contact base ring 40 that defines a terminal axis 42. The electric contact 36 also includes a plurality of contact arms 44 that extend from the contact base ring 40 in a contact direction toward the outer end 32 of the terminal portion 28. From the contact base ring 40, each of the contact arms 44 is angled in an inward direction, toward the terminal axis 42, to a respective contact area 48. From the contact area 48, each of the contact arms 44 continues to extend in the contact direction toward the outer end 32 of the terminal portion 28, but is angled in an outward direction, away from the terminal axis 42, to a generally-cylindrical outer ring 50 that is located around the terminal axis 42. It should be appreciated that the contact area 48 may be an extended portion of the contact arms 44, if desired and may have any cross-sectional shape desired. As previously-described, the illustrated electric contact 36 is stamped from a single piece of sheet metal, and opposed edges of the electric contact 36 are brought together to form a longitudinal gap 52.

The connector terminal 22 is a female-type electric connector and is configured to mate with a male pin terminal 54. It should be appreciated that the male pin terminal 54 is the corresponding pin terminal on the inlet 20. The cap opening 34 allows the male pin terminal 54 to be inserted into the terminal body 24 to engage the electric contact 36, as will be described in detail below.

Figure 5:
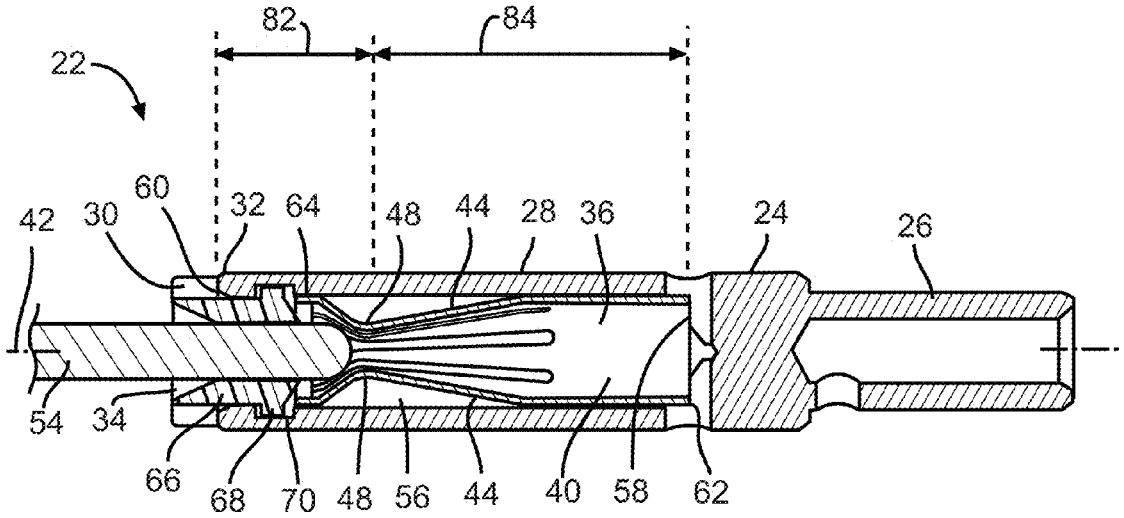
FIG. 5 is a cross-sectional view taken along the line 5-5 of FIG. 3, showing a male terminal inserted into the connector terminal.

Referring now to FIG. 5, a cross-sectional view taken along the line 5-5 of FIG. 3 is shown. The male pin terminal 54 is also shown partially inserted into the connector terminal 22. The terminal portion 28 of the terminal body 24 defines a generally-cylindrical interior space 56. The interior space 56 extends from an interior wall 58 of the terminal body 24 to an outer opening 60 at the outer end 32 of the terminal portion 28. The electric contact 36 is located within the interior space 56. When constructed, the electric contact 36 has an initial diameter that is larger than an inside diameter of the interior space 56. The longitudinal gap 52 allows the contact base ring 40 and the outer ring 50 to be compressed to an assembled diameter that is smaller than the inside diameter of the interior space 56. This allows the electric contact 36 to fit within the smaller-diameter of the interior space 56. As a result, the resilient contact base ring 40 and the outer ring 50 are biased into contact with the terminal portion 28 of the terminal body 24. This contact helps to maintain good electrical conductivity between the terminal body 24 and the electric contact 36. An inner contact end 62 of the electric contact 36 is located adjacent the interior wall 58, and an outer contact end 64 of the electric contact 36 is located toward the outer opening 60.

The end cap 30 is located on the outer end 32 of the terminal portion 28 and includes resilient attachment arms 66 that extend through the outer opening 60 into the interior space 56. The attachment arms 66 include hooks 68 that engage an interior groove 70 defined by the terminal body 24 inside the interior space 56. The attachment arms 66 and hooks 68 snap-fit into the interior groove 70 and retain the end cap 30 connector terminal 22 by cooperating with a cap flange 72 that engages the outer end 32 of the terminal portion 28. Alternatively, the end cap 30 may be retained on the connector terminal 22 by any desired technique.

The end cap 30 also includes end cap interior walls 74 (best seen in FIG. 4) that extend through the outer opening 60 into the interior space 56. The end cap interior walls 74 define a portion of the cap opening 34. The end cap 30 serves, in part, to retain the electric contact 36 within the interior space 56, as the electric contact 36 is captive between the interior wall 58 of the terminal body 24 and the end cap interior walls 74. The end cap 30 also serves, in part, to help guide the male pin terminal 54 into proper alignment to engage the contact arms 44 of the electric contact 36 when the male pin terminal 54 is mated with the connector terminal 22.

Figure 7:
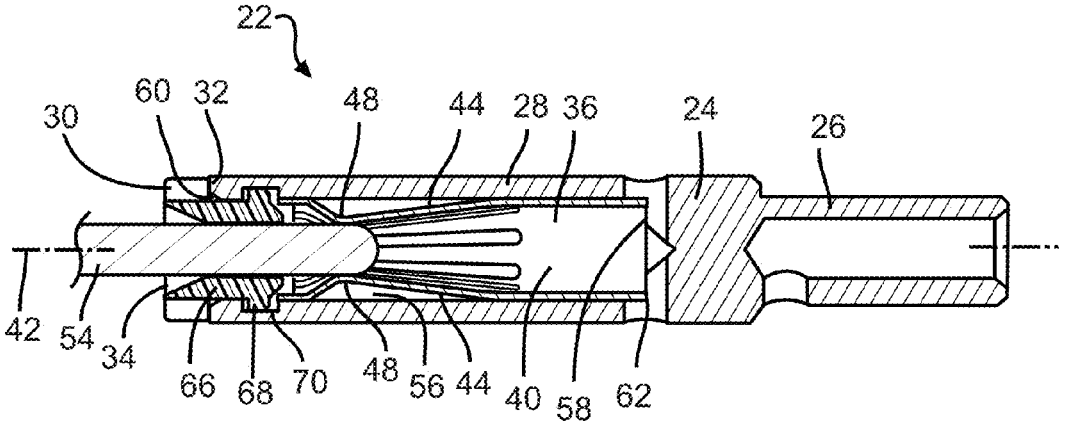
FIG. 7 is a cross-sectional view similar to that shown in FIG. 5, but showing the male terminal engaged with a terminal cage of the connector terminal.
Figure 8:
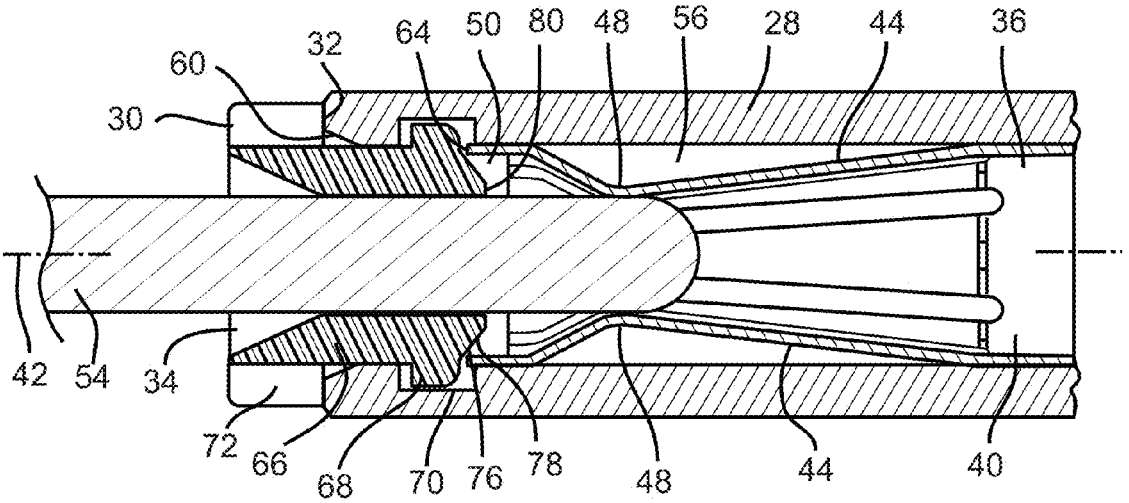
FIG. 8 is a detail view of a portion of FIG. 7.

Referring now to FIG. 7 and FIG. 8, a cross-section of the connector terminal 22 is shown with the male pin terminal 54 further inserted. When the male pin terminal 54 is inserted into the connector terminal 22, the male pin terminal 54 initially engages the portion of the contact arms 44 between the contact area 48 and the outer ring 50. The engagement of the male pin terminal 54 with the contact arms 44 creates an electrical connection between the male pin terminal 54 and the connector terminal 22. The contact arms 44 are deflected in the outward direction, away from the terminal axis 42, and the contact area 48 of each contact arm 44 remains engaged with the male pin terminal 54. As shown in FIG. 7, the electric contact 36 provides paths for electrical current to travel between the male pin terminal 54 and the terminal body 24 through the contact arms 44 and the contact base ring 40, and also through the contact arms 44 and the outer ring 50. Thus, it is advantageous that both the contact base ring 40 and the outer ring 50 remain in contact with the terminal body 24.

In addition to providing a path for electrical current, the outer ring 50 may also help provide the electric contact 36 with protection from physical damage. The outer ring 50 connects each of the contact arms 44, and the contact arms 44 do not have distal ends that are susceptible to damage when the male pin terminal 54 is inserted into the interior space 56.

Figure 6:
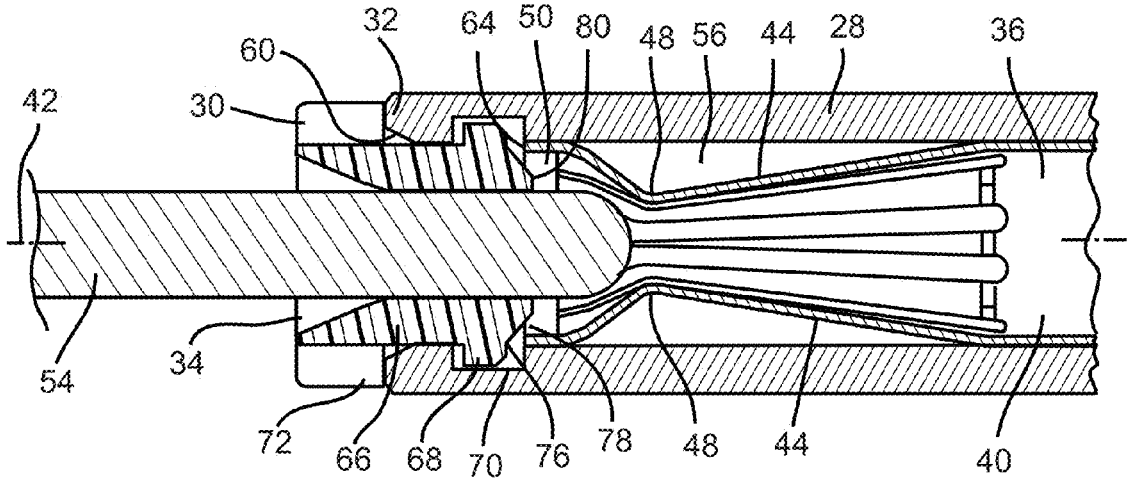
FIG. 6 is a detail view of a portion of FIG. 5.

The end cap interior walls 74 include an optional angled end 76 that may further help protect the electric contact 36 from damage. As seen in FIG. 6, an acute angle is defined between the angled end 76 and the terminal body 24. There is a generally-triangularly-shaped channel 78 defined between the end cap interior walls 74 and the terminal body 24. The outer contact end 64 is located within the channel 78. That is, the end cap 30 includes an inner cap end 80 that is located farther from the outer opening 60 than the outer contact end 64 is, and the inner cap end 80 is located closer to the terminal axis than the outer contact end 64 is. As seen in FIG. 8, when the male pin terminal 54 engages the electric contact 36, the outward deflection of the contact arms 44 causes the distance between the contact base ring 40 and the outer ring 50 to increase. As a result, the outer contact end 64 moves further into the channel 78 and closer to the end cap 30. It should be appreciated that this means that the male pin terminal 54 is less likely to engage the outer contact end 64.

It should be appreciated that the resilient electric contact 36 may be beneficial in preventing tolerance variations during manufacturing, or degradation from repeated use, from causing the electrical connection between the male pin terminal 54 and the connector terminal 22 from becoming loose or otherwise insecure.

As can be seen in FIG. 5, the contact area 48 is located a first distance 82 from the outer opening 60 and a second distance 84 from the interior wall, wherein the second distance 84 is greater than the first distance 82. Therefore, the contact area 48 is not located at the mid-point of the length of the interior space 56. Alternatively, the contact area 48 may be located at any desired location along the length of the electric contact 36. Further, the contact areas 48 may be located at different positions on different contact arms 44, if desired.

As seen in reference to FIG. 2, the connector assembly 18 includes a plurality of connector terminal 22. When the connector assembly 18 engages the inlet 20, it may be desirable that the connector terminals 22 engage the respective corresponding terminals in a specific sequence. In the event that the connector assembly 18 is being used to replace an existing connector assembly, it may be desirable to maintain the same sequence. The relative location of the contact area 48 in different connector terminals 22 can be selected to control the sequence in which the connector terminals 22 will engage the corresponding terminals.

While exemplary embodiment is described above, it is not intended that this describes all possible forms of the invention. Rather, the words used in the specification are words of description rather than limitation, and it is understood that various changes may be made without departing from the spirit and scope of the invention. Additionally, the features of implementing embodiment may be combined to form further embodiments of the invention.

Additionally, the illustrated charging system 10 is one illustrative, non-limiting example of an environment in which the connector assembly 18 is suitable for use. The connector assembly 18 and the connector terminal 22 may be used in other environments and for other purposes where a electrical connection is desired.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electric connector comprising:

a terminal body defining an interior space; and an electric contact located within the internal space and including a base contact ring that is biased into engagement with the terminal body, an outer ring that is biased into engagement with the terminal body, and a contact arm that extends from the base contact ring to the outer ring, wherein either:

(1) the contact arm is angled in an inward direction from the base contact ring to a contact area, and further is angled in an outward direction from the contact area to the outer ring; or (2) the interior space extends between an interior wall of the terminal body and an outer opening, and an end cap extends through the outer opening and retains the electric contact in the interior space.

2. The electric connector of claim 1, wherein the contact arm is angled in an inward direction from the base contact ring to a contact area, and further is angled in an outward direction from the contact area to the outer ring.

3. The electric connector of claim 1, wherein the interior space is generally cylindrical, the base contact ring is generally cylindrical, and the outer ring is generally cylindrical.

4. The electric connector of claim 1, further comprising an end cap that retains the electric contact in the interior space.

5. The electric connector of claim 4, wherein the interior space extends between an interior wall of the terminal body and an outer opening, and the end cap extends through the outer opening.

6. The electric connector of claim 5, wherein the end cap includes interior walls and a channel is defined between the end cap interior walls and the terminal body, and wherein the electric contact includes an outer contact end that is located within the channel.

7. The electric connector of claim 6, wherein the outer contact end is the portion of the electric contact closest to the outer opening.

8. The electric connector of claim 5, wherein the electric contact includes an outer contact end that is the portion of the electric contact closest to the outer opening, and the end cap includes an inner cap end that is located farther from the outer opening than the outer contact end is.

9. The electric connector of claim 8, wherein the contact area is located a first distance from the outer opening and a second distance from the interior wall, and wherein the second distance is different than the first distance.

10. An electric connector comprising:

a terminal body defining an interior space between an interior wall of the terminal body and an outer opening; and an electric contact located within the internal space and including a base contact ring adjacent the interior wall that is biased into engagement with the terminal body, a plurality of contact arms that extend from the contact base ring toward the outer opening, each of the contact arms angled in an inward direction toward a terminal axis to a contact area and in an outward direction away from the terminal axis to an outer ring that is biased into engagement with the terminal body.

11. The electric connector of claim 10, wherein the contact area is located a first distance from the outer opening and a second distance from the interior wall, and wherein the second distance is different than the first distance.

12. The electric connector of claim 11, further comprising an end cap that retains the electric contact in the interior space.

13. The electric connector of claim 12, wherein the end cap extends through the outer opening.

14. The electric connector of claim 13, wherein the end cap includes interior walls and a channel is defined between the end cap interior walls and the terminal body, and wherein the electric contact includes an outer contact end that is located within the channel.

15. The electric connector of claim 14, wherein the outer contact end is the portion of the electric contact closest to the outer opening.

16. The electric connector of claim 15, wherein the interior space is generally cylindrical, the base contact ring is generally cylindrical, and the outer ring is generally cylindrical.

17. The electric connector of claim 11, wherein the interior space is generally cylindrical, the base contact ring is generally cylindrical, and the outer ring is generally cylindrical.

* * * * *